US010018197B2

(12) United States Patent
Franzen

(10) Patent No.: US 10,018,197 B2
(45) Date of Patent: Jul. 10, 2018

(54) LOW-PULSE VANE PUMPS

(71) Applicant: Hamilton Sundstrand Corporation, Charlotte, NC (US)

(72) Inventor: Mark F. Franzen, Brodhead, WI (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 370 days.

(21) Appl. No.: 14/599,282

(22) Filed: Jan. 16, 2015

(65) Prior Publication Data

US 2016/0208799 A1 Jul. 21, 2016

(51) Int. Cl.

| | |
|---|---|
| ***F04C 18/00*** | (2006.01) |
| ***F01C 20/18*** | (2006.01) |
| ***F04C 28/18*** | (2006.01) |
| ***F04C 2/344*** | (2006.01) |
| ***F04C 15/00*** | (2006.01) |

(52) U.S. Cl.

CPC ..... *F04C 2/344* (2013.01); *F04C 2/3441* (2013.01); *F04C 15/0049* (2013.01); *F04C 2250/301* (2013.01); *F04C 2270/14* (2013.01)

(58) Field of Classification Search

CPC ..... F01C 21/0836; F01C 21/106; F04C 15/0049; F04C 2/3441

USPC ..... 418/150

See application file for complete search history.

(56) References Cited

U.S. PATENT DOCUMENTS 1,984,365 A * 12/1934 English ..... F01C 21/0845 418/266
3,514,237 A 5/1970 Spyridakis
5,226,803 A 7/1993 Martin

FOREIGN PATENT DOCUMENTS

GB 2315815 A 2/1998
WO WO-2014/138870 A1 9/2014

OTHER PUBLICATIONS

Extended European Search Report dated Jun. 6, 2016, issued during the prosecution of European Patent Application No. 16151674.5 (7 pages).

* cited by examiner

*Primary Examiner* — Mark Laurenzi
*Assistant Examiner* — Anthony Ayala Delgado
(74) *Attorney, Agent, or Firm* — Locke Lord LLP; Daniel J. Fiorello; Scott D. Wofsy

(57) ABSTRACT

The vane pump includes a housing enclosing the rotor and vanes, the housing including an inner surface defined by a core profile to cause the vanes to extend and retract radially to provide a predetermined vane displacement with rotation of the vanes. The core profile includes an inlet profile portion and an outlet profile portion, wherein the core profile includes a vane radius modifying portion defined between the inlet profile portion and the outlet profile portion such that a radial extension of a vane that is guided along the inner surface will change when transiting the vane radius modifying portion.

11 Claims, 1 Drawing Sheet

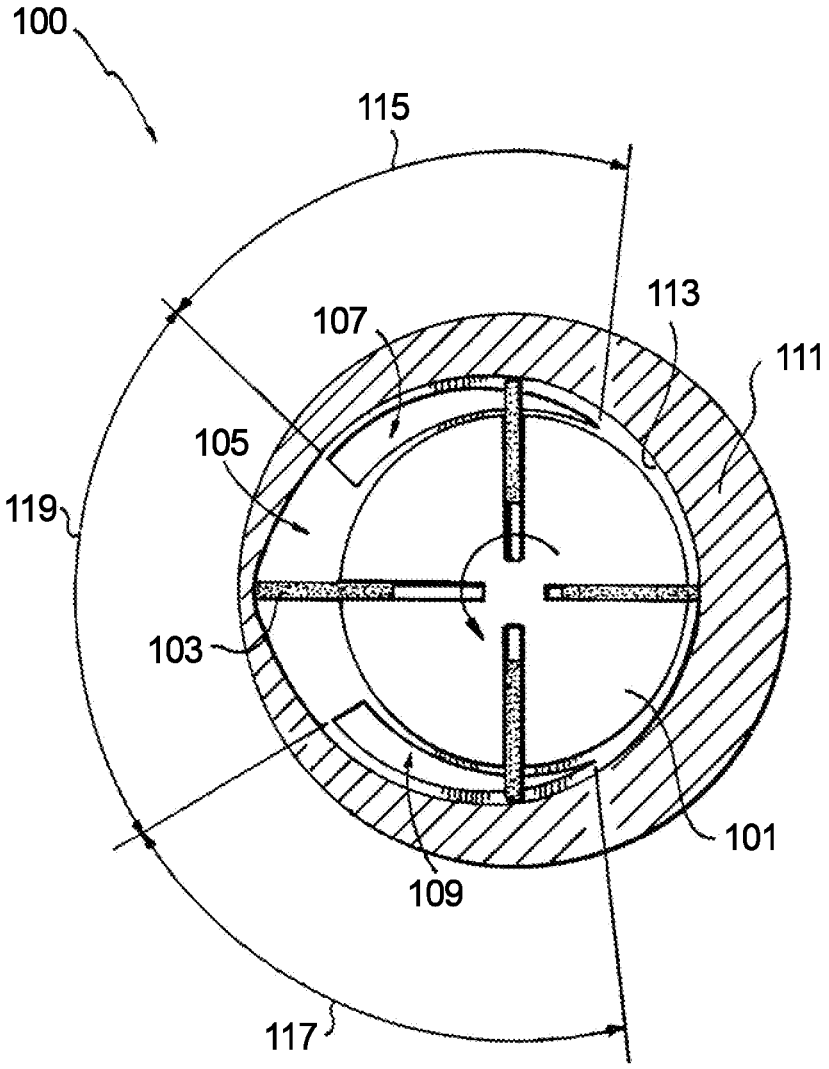
100
115
113
107
111
105
119
103
101
109
117

LOW-PULSE VANE PUMPS

BACKGROUND

1. Field

The present disclosure relates to fluid pumps, more specifically to vane pumps.

2. Description of Related Art

A vane pump is a type of positive displacement pump. The pump displacement is positive in the sense that rotation of the pump rotor displaces fluid from the pump body to the pump outlet in proportion to the rotation of the rotor. The coefficient of proportionality is termed the displacement of the pump. A low-pulse pump produces substantially uniform displacement across the entire rotational cycle of the pump.

Achievement of uniform displacement is typically prevented by the presence of pump vanes that impel the fluid from a pump inlet to a pump outlet. Each vane displaces a diminishing amount of fluid as it retracts into the rotor as it sweeps past the pump outlet. Similarly, a variation in pump displacement occurs as the trailing vane sweeps from the pump inlet to the pump outlet if the pump core does not have uniform radial separation from the rotor across the passage from pump inlet to pump outlet.

Such conventional methods and systems have generally been considered satisfactory for their intended purpose. However, there is still a need in the art for improved vane pumps with low-pulse. The present disclosure provides a solution for this need.

SUMMARY

A vane pump includes a rotor and a plurality of vanes extending radially outward therefrom. The vanes are slidably movable relative to the rotor in a radial direction such that the vanes can extend from and retract toward the rotor. The vanes define a plurality of circumferentially spaced vane cavities, wherein a respective vane cavity is defined between each adjacent pair of the vanes. The vane pump also includes an inlet in fluid communication with the vane cavities to accept a fluid into the vane cavities and an outlet in fluid communication with the vane cavities to allow the fluid to exit the vane cavities.

The vane pump includes a housing enclosing the rotor and vanes, the housing including an inner surface defined by a core profile to cause the vanes to extend and retract radially to provide a predetermined pump displacement with rotation of the vanes. The core profile includes an inlet profile portion, an outlet profile portion, and a vane radius modifying portion defined between the inlet profile portion and the outlet profile portion such that a radial extension of a vane that is guided along the inner surface will change when transiting each portion.

The vane radius modifying portion can include a non-linear profile. The non-linear profile can be defined by a fourth order curve or any other suitable curve for a given application.

The vane radius modifying portion can be symmetric about a mid-point between the inlet and the outlet. The vane radius modifying portion can be defined based on the slope of the outlet profile portion and a vane dimension. The vane radius modifying portion can start at about zero slope at the inlet profile portion, increase in slope, decrease to zero slope at the mid-point, then decrease to a negative slope, and end at about a zero slope at the outlet profile portion in the direction of rotation from the inlet to the outlet.

A method for reducing flow pulses for a vane pump includes modifying an extended radius of a vane in a vane radius modifying portion between an inlet and an outlet of the vane pump to create a substantially steady pump flow rate.

Modifying the extended radius of the vane can include non-linearly modifying the extended radius. Modifying the extended radius of the vane can include non-linearly increasing the extended radius to a midpoint between the inlet and the outlet. Modifying the extended radius of the vane can include non-linearly decreasing the extended radius after the midpoint.

Modifying the extended radius of the vane can include modifying the extended radius based on an outlet profile portion and a vane dimension. These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 1 is a cross-sectional view of an embodiment of a low-pulse vane pump in accordance with this disclosure, showing a non-linear vane radius modifying portion between an inlet and an outlet of the vane pump.

DETAILED DESCRIPTION

Reference will now be made to the drawings wherein like reference numerals identify similar structural features or aspects of the subject disclosure. For purposes of explanation and illustration, and not limitation, an illustrative view of an embodiment of a vane pump in accordance with the disclosure is shown in FIG. 1 and is designated generally by reference character 100. The systems and methods described herein can be used to reduce or remove pulsing in a vane pump.

Referring to FIG. 1, a vane pump includes a rotor 101 and a plurality of vanes 103 disposed within the rotor 101 and extending radially outward therefrom. The vanes 103 are slidably movable relative to the rotor 101 in a radial direction such that the vanes 103 can extend from and retract into the rotor 101.

The vanes 103 create a plurality of vane cavities 105 between each pair of vanes 103. The vane pump 100 also includes an inlet 107 operative to accept a fluid into the vane cavities 105 and an outlet 109 operative to allow the fluid to exit the vane cavities 105.

The vane pump 100 includes a housing 111 enclosing the rotor 101 and vanes 103. The housing 111 has an inner surface 113 defined by a core profile to cause the vanes 103 to extend and retract radially to provide a predetermined vane displacement with rotation of the rotor 101 in a rotational direction. The vanes 103 can be biased radially outward in any suitable manner (e.g., using a spring, a camming mechanism).

The core profile includes an inlet profile portion 115 and an outlet profile portion 117. At the inlet profile portion 115, the core profile generally includes an upward slope to increase the extended radius of each vane 103 passing across the inlet profile portion 115. This causes the volume of the vane cavities 105 at the inlet 107 to increase, thereby drawing in fluid from the inlet 107. At the outlet profile portion 117, core profile generally includes a downward slope to decrease the extended radius of each vane 103 passing across the outlet profile portion 117. This causes the volume of the vane cavities 105 at the outlet 109 to decrease, thereby pushing fluid out through the outlet 109.

The core profile also includes a vane radius modifying portion 119 defined between the inlet profile portion 115 and the outlet profile portion 117 such that a radial extension of a vane 103 that is guided along the inner surface 113 changes when transiting the vane radius modifying portion 119.

The vane radius modifying portion 119 can include a non-linear profile. The non-linear profile can be defined by a fourth order curve or any other suitable curve for a given application. It is also contemplated that at least a portion of the vane radius modifying portion 119 can include a linear profile for modifying radius for the purposes disclosed herein.

The vane radius modifying portion 119 can be symmetric about a mid-point between the inlet 107 and the outlet 109. In certain embodiments, the vane radius modifying portion 119 can be defined as a function of the slope of the outlet profile portion 117 and a vane dimension. The vane radius modifying portion 119 can start at about zero slope at the end of the inlet profile portion 115, increase in slope, then decrease in slope to about zero slope (e.g., at the mid-point between the inlet 107 and the outlet 109). Then, the slope can decrease to a negative slope and end at about a zero slope at the beginning of the outlet profile portion 117. The above configuration is listed relative to the direction of rotation from the inlet 107 to the outlet 109 as shown.

The incremental pump displacement induced by retraction of a vane 103 as it traverses the outlet profile portion 117 equals the rate of change with respect to rotor rotation in vane volume exposed between the rotor surface 101 and outlet profile portion 117. The vane-induced incremental pump displacement is offset by profiling the vane radius modifying portion 119 to induce an equal and opposite incremental pump displacement relative to that which would be otherwise be produced if the vane radius modifying portion 119 were of uniform radius.

In accordance with an aspect of this disclosure, a method for reducing flow pulses for a vane pump 100 includes modifying an extended radius of a vane 103 in a vane radius modifying portion 119 between an inlet 107 and an outlet 109 of the vane pump 100 to create an opposite pulse to offset the pulse that would otherwise be present without the vane radius modifying portion 119.

Modifying the extended radius of the vane 103 can include non-linearly modifying the extended radius. Modifying the extended radius of the vane 103 can include non-linearly increasing the extended radius to a midpoint. Modifying the extended radius of the vane 103 can include non-linearly decreasing the extended radius after the mid-point.

In certain embodiments, modifying the extended radius of the vane 103 can include modifying the extended radius based on an outlet profile portion 115 and a vane dimension.

As will be appreciated by one having ordinary skill in the art, it is shown that traditional vane pumps have a pulsing displacement, whereas the above described pumps maintain a substantially constant displacement due to the reduction in pulsing.

In accordance with the above embodiments, low-pulse vane pumps are provided such that the variation in pump displacement caused by retraction of a vane as it sweeps across the outlet of the pump is offset by advantageous contouring of the pump core to produce instantaneously equal and opposite variation in displacement as the trailing vane sweeps from pump inlet to pump outlet.

The methods and systems of the present disclosure, as described above and shown in the drawings, provide for a vane pump with superior properties including reduced pulsing during operation. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A vane pump, comprising:

a rotor;

a plurality of vanes extending radially outward therefrom, the vanes being slidably movable relative to the rotor in a radial direction such that the vanes can extend from and retract into the rotor and define a plurality of circumferentially spaced vane cavities, wherein a respective vane cavity is defined between each adjacent pair of the vanes;

an inlet in fluid communication with the vane cavities to accept a fluid into the vane cavities;

an outlet in fluid communication with the vane cavities to allow the fluid to exit the vane cavities; and a housing enclosing the rotor and vanes, the housing including an inner surface defined by a core profile to cause the vanes to extend and retract radially to provide a predetermined pump displacement with rotation of the vanes, wherein the core profile includes an inlet profile portion and an outlet profile portion, wherein the core profile includes a vane radius modifying portion defined between the inlet profile portion and the outlet profile portion such that a radial extension of one of the plurality of vane that is guided along the inner surface will change at a higher rate when transiting the vane radius modifying portion than when transiting the inlet profile portion or the outlet profile portion.

2. The vane pump of claim 1, wherein the vane radius modifying portion includes a non-linear profile.

3. The vane pump of claim 2, wherein the non-linear profile is defined by a fourth order slope.

4. The vane pump of claim 1, wherein the vane radius modifying portion is symmetric about a mid-point.

5. The vane pump of claim 1, wherein the vane radius modifying portion is defined based on the slope of the outlet profile portion and a vane dimension.

6. The vane pump of claim 1, wherein the vane radius modifying portion starts at about zero slope at the inlet profile portion, increases in slope, decreases in slope, to about zero slope, then decreases in slope to a negative slope, and ends at about a zero slope at the outlet profile portion in the direction of rotation from the inlet to the outlet.

7. A method for reducing flow pulses for a vane pump, the method comprising:

modifying, using a vane radius modifying portion, an extended radius of a vane at a higher rate between an inlet and an outlet of the vane pump than when transiting an inlet profile portion or an outlet profile portion to create an opposite pulse to offset an existing pulse.

8. The method of claim 7, wherein modifying the extended radius of the vane includes non-linearly modifying the extended radius.

9. The method of claim 7, wherein modifying the extended radius of the vane includes non-linearly increasing the extended radius to a midpoint.

10. The method of claim 9, wherein modifying the extended radius of the vane includes non-linearly decreasing the extended radius to after the midpoint.

11. The method of claim 7, wherein modifying the extended radius of the vane includes modifying the extended radius based on an outlet profile portion and a vane dimension.

* * * * *